United States Patent [19]

Stange

[11] 4,099,810

[45] Jul. 11, 1978

[54] UPRIGHT DOCUMENT CAROUSEL

[75] Inventor: Klaus K. Stange, Pittsford, N.Y.

[73] Assignee: Xerox Corporation, Stamford, Conn.

[21] Appl. No.: 688,864

[22] Filed: May 21, 1976

[51] Int. Cl.[2] ..... B65H 39/10

[52] U.S. Cl. ..... 312/183; 312/59; 271/9; 271/173

[58] Field of Search ..... 312/197, 183, 97.1, 312/59, 183; 302/2 R; 271/173, 64, D9, 97, 3, 9, 195; 221/278

[56] References Cited

U.S. PATENT DOCUMENTS

| | | | |
|---|---|---|---|
| 253,290 | 2/1882 | Hunter | 312/183 X |
| 603,316 | 5/1898 | Bush | 312/39 |
| 1,683,491 | 9/1928 | Ripron | 312/183 |
| 2,993,737 | 7/1963 | Stephen | 302/2 R |
| 3,040,727 | 6/1962 | Edwards et al. | 221/278 |
| 3,096,089 | 7/1963 | Swenker et al. | 271/173 |
| 3,119,394 | 1/1964 | Knittel | 312/59 |
| 3,334,785 | 8/1967 | Grabausle et al. | 360/88 X |
| 3,334,950 | 8/1967 | Brownlee | 312/97.1 |
| 3,406,382 | 10/1968 | Welmer | 271/9 X |
| 3,649,081 | 3/1972 | Johnson et al. | 302/2 R |
| 3,685,671 | 8/1972 | Layman | 302/2 R |
| 3,747,754 | 7/1973 | Nix et al. | 312/59 |

*Primary Examiner*—Paul R. Gilliam
*Assistant Examiner*—Victor N. Sakran

[57] ABSTRACT

Apparatus for storing documents includes a cylindrical housing and, in the housing, an upright carousel having a number of radially disposed pockets. The housing has a horizontally and radially extending opening on a vertical wall and a horizontal opening on an outer cylindrical wall, the openings being located on opposite sides of the axis of the housing. A drive is available for separately aligning the pockets with the openings. Each opening is associated with means for providing a fluid stream and fluid streams are generated for moving documents, through an associated opening, into or out of pockets. The carousel includes radially extending plates which define the pockets and said plates have radial projections which slidably engage the housing. The engagement is provided to prevent document jams when loaded pockets are moved through the lower part of the housing.

1 Claim, 3 Drawing Figures

UPRIGHT DOCUMENT CAROUSEL

The subject invention generally relates to apparatus for storing and feeding documents, such as disclosed in co-pending U.S. patent application Ser. No. 638,584, A Document Storage Rack, filed on Dec. 8, 1975, on an invention by Klaus K. Stange et al, and co-pending U.S patent application Ser. No. 665,826, A Document Carousel, filed on Mar. 11, 1976, on an invention by Klaus K. Stange, the applications being assigned to the assignee herein, Xerox Corporation.

The public is aware of apparatus for storing and feeding documents wherein documents are stored in a bin and drive rollers engaging the top of the stack serially discharage the documents from the bin. In such apparatus frictional forces cause the documents to rub against each other and when the documents are repeatedly subjected to such treatments images on the documents and the documents themselves deteriorate. As an alternative to such apparatus suction or fluidic means have been devised for lifting documents from the top of a stack of documents and for transporting the documents. However, since documents are frequently provided on sheets of porous paper these devices tend to pick up more than one document at a time and this interferes with serial feeding which is frequently desired.

It is an object of the present invention to provide apparatus for separately storing documents and for serially delivering the documents.

It is another object of the present invention to provide apparatus for storing documents and for fluidically discharging stored documents.

Still another object of the present invention is to provide storage apparatus wherein documents are fluidically drawn into a conveyor for storage and wherein said documents are fluidically discharged as desired.

Briefly, the invention disclosed herein for storing documents includes: (a) a housing having an opening; (b) a carousel having a number of pockets, said carousel being rotatably supported in the housing, the axis of rotation of the carousel having a horizontally disposed directional component; (c) drive means for rotating the carousel with respect to the housing, whereby said pockets may be aligned with the opening; and (d) fluidic means for moving documents stored in said pockets through said opening.

Additional objects and features of the invention will become apparent by reference to the following description in conjunction with the accompanying drawings, in which.

Figure 1:
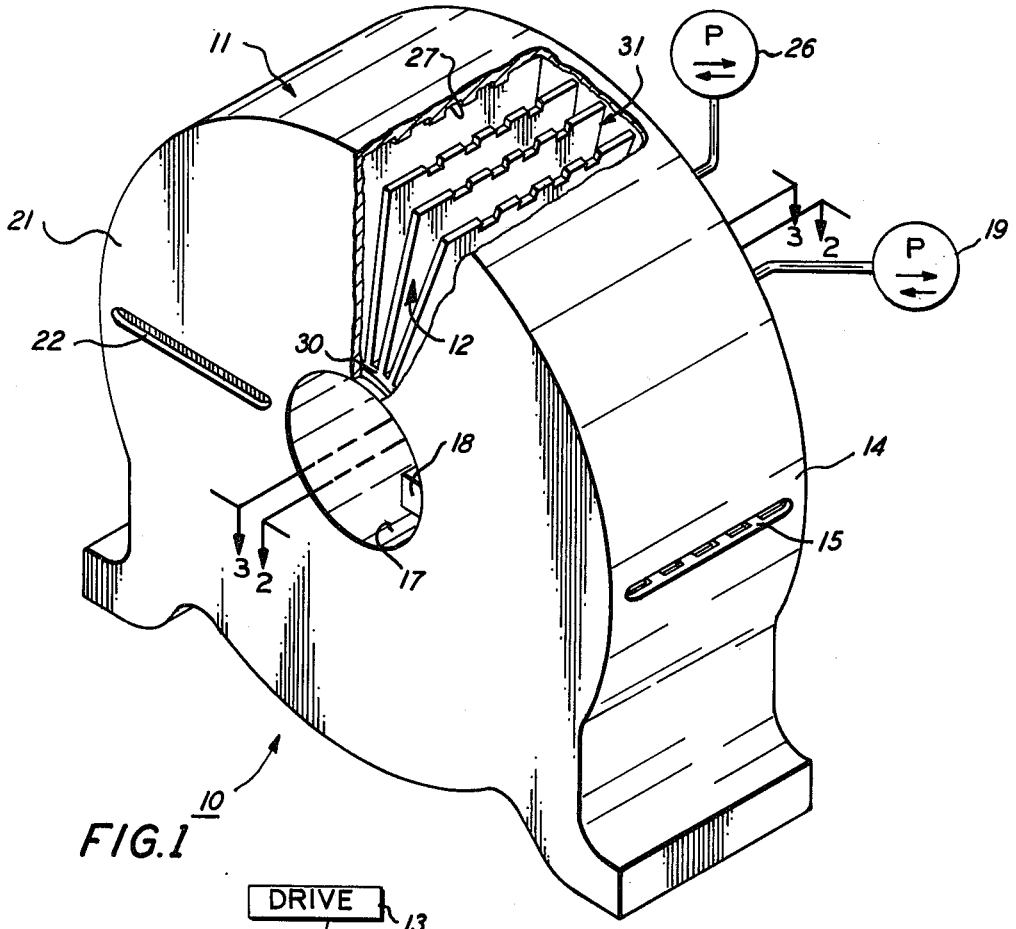
FIG. 1 is a perpespective view of apparatus for storing documents, according to the invention, a section having been removed to disclose a carousel member.
Figure 2:
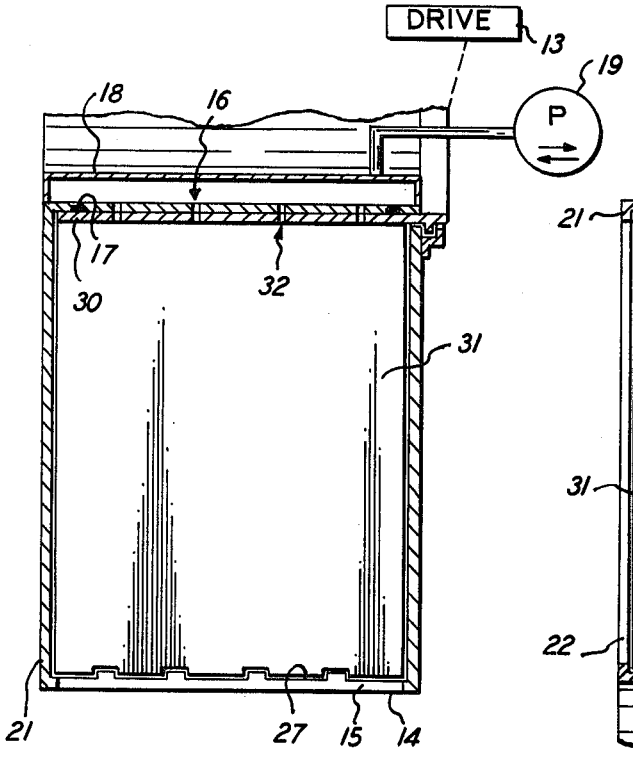
FIG. 2 is a partial cross-sectional view of the storage apparatus, the view having been taken along lines 2—2 in FIG. 1.
Figure 3:
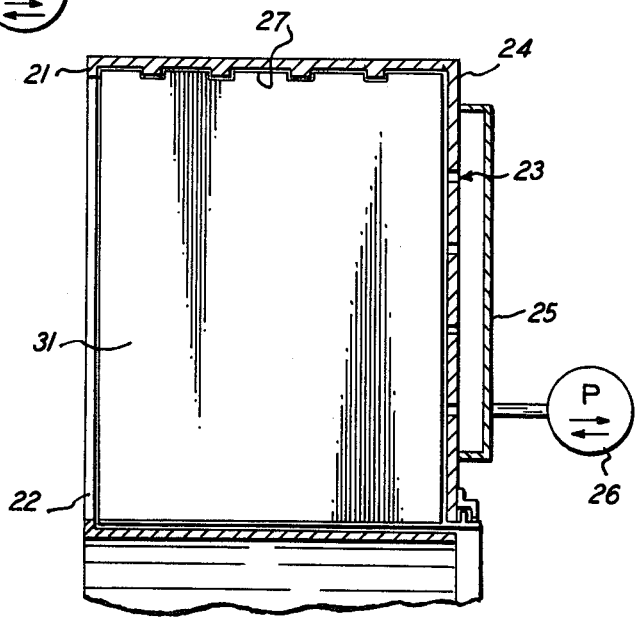
FIG. 3 is a partial cross-sectional view of the storage apparatus, the view having been taken along lines 3—3 in FIG. 1.

Referring to FIGS. 1 and 2, apparatus for storing documents 10, according to the invention, includes a vertically disposed torus type housing 11, of rectangular cross section, within which there is rotatably mounted a carousel 12. Carousel 12 is coupled to drive means 13 for rotating the carousel in a stepwise or continuous manner. The outer cylindrical wall 14 of housing 11 includes a horizontally disposed opening 15 which is horizontally aligned with a series of holes 16 (see FIG. 2) located on the inner cylindrical wall 17 of housing 11. Holes 16 communicate with the inside of the housing and with the chamber of a manifold 18 coupled to the housing. Manifold 18 is coupled to a fluid pump 19 which, as will be explained below, cooperates with the holes and manifold to provide a fluid stream for discharging through opening 15 documents stored in the carousel. A vertical wall 21 of the housing includes a horizontally and radially extending opening or slot 22 aligned with a horizontally oriented bunch of holes 23 (see FIG. 3) located on another vertical wall 24 of the housing. Holes 23 communicate with the inside of the housing and with the chamber of a manifold 25 coupled to the housing. Manifold 25 is coupled to a reversible fluid pump 26 which, as will appear, cooperates with holes 23 and manifold 25 to provide a fluid stream for discharging documents in the carousel through the opening 22 or for drawing documents inserted through opening 22 into the carousel 12.

Carousel 12 includes an annular member 30 which is rotatably coupled to the housing, the axis of rotation of the member being horizontally disposed, and a plurality of spaced plates 31. Plates 31 are secured to the member and are radially disposed, the angular distance between any two adjacent plates being the same. The part of wall 14 within the housing includes a number of circular grooves 27 into which projections on the ends of plates 31 extend. As will become apparent, this engagement will prevent document jams when loaded pockets are moved through the lower part of the housing. As may be seen in FIG. 2 or 3, the plates are also in near contact with walls 21 and 24. Referring to FIG. 2, between each adjacent pair of plates there is located in the member 30 a set of radially disposed holes 32 which may be aligned with the series of holes 16. Therefore, it will be appreciated that if a document is located in a pocket, defined by a pair of adjacent plates and the member, and if a set of holes communicating with that pocket is aligned with the series of holes 16 a blast of air provided by pump 19 may be used to move the document through opening 15 and out of the apparatus. As previously stated, member 30 is coupled to drive means 13. Drive 13 may simply be a selectively activatable motor capable of aligning any one of the sets of holes with the series of holes. Alternatively, drive 13 may be a servomechanism. It will be understood by persons skilled in the servomechanism art that position sensors may be used to align any one of the sets of holes with the series of holes with a minimum amount of hunting and that the carousel can be stepped along to serially align the sets of holes for moments of time with the series of holes. Therefore, it will be appreciated that documents located in any or all of the carousel pockets may be discharged through opening 15.

Carousel 12 may be rotated such that its pockets are brought into alignment with opening 22 and holes 23. Therefore, a fluid stream generated by pump 26 may be used to discharge documents in any of the pockets or, if pump 26 is operated in a vacuum mode, a fluid stream may be used to draw documents inserted through opening 22 into pockets. In the subject embodiment a pocket is aligned with opening 22 and holes 23 when the series of holes 16 is aligned with one of the sets of holes. Therefore, if desired, documents may be moved into or out of the carousel through openings 15 and 22 simultaneously.

Operatively, when a document is moved through one of the openings into a pocket the carousel may be rotated so that the document is moved into the upper or lower half of the housing for storage. Documents moved into the lower half of the housing may be acted on by gravitational forces and moved thereby into contact with wall 14. However, the projections on the plates prevent slippage of the documents out of the pockets. The engagement preventing slippage is particularly important when documents to be stored or transported are flimsy, it being understood that stiff documents moved while in contact with the inside of wall 14 will not be subject to being dragged between the plates and wall. In this embodiment the grooves on wall 14 are circular. However, it will be appreciated that only arcuate grooves in the lower half of the housing are needed for a working embodiment.

The apparatus shown may be modified in many ways without deviating from the spirit of the invention. For example, apparatus may be provided wherein pump 26, manifold 25, holes 23 and opening 22 are missing or are replaced with an arrangement similar to pump 19, manifold 18, and holes 16; or opening 15 may be removed or replaced with an arrangement such as pump 26, manifold 25, holes 23, and opening 22. The embodiment described may also be modified so as to provide an oblong as opposed to a circular path of travel for the pockets. Accordingly, it is to be understood that the description herein of a preferred embodiment, according to the invention, has been set forth as an example thereof and is not to be construed or interpreted to provide limitations on the claims which follow and define the invention.

What is claimed is:

1. Apparatus for storing documents, comprising:

(a) a housing having a slot on one side and one or more holes on another side, said slot and said one or more holes being aligned;

(b) a carousel having a number of pockets, said carousel being rotatably supported in the housing, the axis of rotation of the carousel having a horizontally disposed directional component;

(c) drive means for rotating the carousel with respect to the housing whereby said pockets may be aligned with the slot and said one or more holes; and (d) means for providing a fluid stream traversing the slot, a pocket, and said one or more holes;

(e) wherein said carousel includes a circular member and a plurality of spaced plates supported by the member, said plates extending away from the axis of rotation and each of said pockets being defined by at least two different adjacent plates and the member;

(f) wherein said housing includes at least one arcuate groove in the lower half of the housing and each of the plates includes at least one projection at the ends of the plates opposite from the axis of rotation, each projection being movable through one of the grooves when the carousel is rotated to prevent slippage of documents out of said pockets.

* * * * *